US008790856B2

(12) United States Patent
Yang et al.

(10) Patent No.: US 8,790,856 B2
(45) Date of Patent: Jul. 29, 2014

(54) LOW DIELECTRIC ADDITIVES FOR TONER

(75) Inventors: Suxia Yang, Mississauga (CA); Richard P N Veregin, Mississauga (CA); Magid Kamel, Toronto (CA); Cuong Vong, Hamilton (CA); Kimberly Nosella, Mississauga (CA); Eric Rotberg, Toronto (CA)

(73) Assignee: Xerox Corporation, Norwalk, CT (US)

( * ) Notice: Subject to any disclaimer, the term of this patent is extended or adjusted under 35 U.S.C. 154(b) by 22 days.

(21) Appl. No.: 13/292,799

(22) Filed: Nov. 9, 2011

(65) Prior Publication Data

US 2013/0115549 A1 May 9, 2013

(51) Int. Cl.
*G03G 9/00* (2006.01)

(52) U.S. Cl.
USPC ..... 430/108.7; 430/108.1

(58) Field of Classification Search
USPC ..... 430/108.1, 108.3, 108.6, 108.7
See application file for complete search history.

(56) References Cited

U.S. PATENT DOCUMENTS

| | | | | |
|---|---|---|---|---|
| 6,610,452 | B2 * | 8/2003 | Combes et al. | 430/108.11 |
| 2008/0070140 | A1 * | 3/2008 | Fomitchev et al. | 430/108.3 |
| 2010/0310983 | A1 * | 12/2010 | Ou et al. | 430/137.14 |
| 2011/0177444 | A1 | 7/2011 | Mattison | |
| 2012/0070771 | A1 * | 3/2012 | Araki et al. | 430/108.3 |
| 2013/0115548 | A1 * | 5/2013 | Yang et al. | 430/105 |

OTHER PUBLICATIONS

Cabot catalog excerpt.

* cited by examiner

*Primary Examiner* — Stewart Fraser
(74) *Attorney, Agent, or Firm* — MDIP LLC

(57) ABSTRACT

The present disclosure describes toner compositions containing an additive package including one or more additives that exhibit low dielectric loss, which toners exhibit improved tribo charging, $2^{nd}$ transfer efficiency and IQ without affecting color.

18 Claims, No Drawings

LOW DIELECTRIC ADDITIVES FOR TONER

FIELD

Toners containing additive packages containing one or more additives which exhibit low dielectric loss, where such toners show improved charging, $2^{nd}$ transfer efficiency and image quality; developers comprising said hyperpigmented toner; devices comprising said toner and developers; imaging device components comprising said toner and developers; imaging devices comprising said developers; images, and so on, are described.

BACKGROUND

Pigments, dyes and colorants often comprise large and/or complicated chemical structures, such as, multiple and/or conjugated rings, which can have varied, detrimental and/or unpredictable electronic properties. For example, black pigments can have high color density (coloring per unit weight), a high blackness degree and high light fastness. In efforts to increase pigment loading, toners containing higher amounts of black pigment, however, exhibit lower charging with high dielectric loss, both of which reduce transfer efficiency and degrade image quality. Black pigments can be conductive due to the formation of pathways through the toner particle, which may contribute to some of the defects noted above.

Therefore, there remains a need to reduce the dielectric loss, and thus, improve charging to enable lower cost toners and hyperpigmented toners.

SUMMARY

The present disclosure describes toner compositions containing one or more additives that exhibit low dielectric loss, which toners exhibit an increase in charging in low humidity and high humidity environments, which improved $2^{nd}$ transfer efficiency and image quality (IQ) under high humidity and meets or exceeds the performance of toners with standard additive packages that do not contain such low dielectric loss additives.

In embodiments, a toner composition is disclosed including an additive package containing one or more additives, wherein the average of the volume fraction ($V_f$) contributions of the one or more additives to total dielectric loss (E"×1000) of all of the surface additives in the package can be calculated using the formula, $$\text{Average } (V_{f \times E'' \times} 1000)$$

is less than about 20, and where the toner exhibits high pigment loading at reduced toner mass per unit area (TMA).

In embodiments, an imaging process is disclosed including contacting toner particles with a substrate, where the particles comprise an additive package containing one or more additives, and where the average of the volume fraction contributions (compared to the volume of all the additives in the additive package) to dielectric loss of all of the surface additives is less than about 20; and fusing the toner particles to the substrate to form an image, where the image for a 100% single color solid area (SCSA) layer has a thickness of between about 1 μm to about 5 μm, and where the thickness of the image is less than about 70% of the diameter of one of the hyperpigmented toner particles.

DETAILED DESCRIPTION

While not being bound by theory, reducing dielectric loss of a toner is important to improve toner performance; if the toner has a lower dielectric loss, then the toner provides higher charge and better transfer and image quality. Given that lower dielectric loss is important in improving toner performance, the dielectric loss of the additives on the toner surface may be important as the additives are responsible for much of the blended toner charge, and also contact the surface of the carrier, photoreceptor and intermediate transfer belt (ITB).

As disclosed herein, performance and dielectric loss of toner additives is demonstrated, in addition to the overall dielectric loss of the toner particle. For example, toner additives having low dielectric loss as a replacement for toner additives having a high dielectric loss have been found to improve toner A zone charge, where such toners exhibit higher transfer and improved mottle and graininess.

An additive of interest is one that comprises a silica which is surface-treated with an alkyl silane (AS), in embodiments, such a silica is one which comprises octyl triethoxy silane (OTS). In embodiments, addition of additives having low dielectric loss results in a boost in charging (e.g., from about 15 to about 70 μC/g, from about 20 to about 60 μC/g, from about 40 to about 70 μC/g), which improves the $2^{nd}$ transfer (e.g., from about 50% to about 95%, from about 60% to about 85%, from about 70% to about 80%) efficiency and IQ in the A zone. In embodiments, the additives as disclosed herein reduces the visual noise high frequency (VNHF) and noise in mottle frequency (NMF) resulting in improved graininess and mottle.

The approach may be used in general toner preparation (e.g., emulsion and aggregation (EA) toners), and may be applied to any toner design which requires a tribo boost, such as hyperpigmented toners, toners comprising a black pigment, toners comprising pigments which negatively impact dielectric loss and so on, and combinations thereof.

I. Definitions

Unless otherwise indicated, all numbers expressing quantities and conditions, and so forth used in the specification and claims are to be understood as being modified in all instances by the term, "about." "About," is meant to indicate a variation of no more than 20% from the stated value. Also used herein is the term, "equivalent," "similar," "essentially," "substantially," "approximating," and "matching," or grammatical variations thereof, have generally acceptable definitions or at the least, are understood to have the same meaning as, "about."

In the application, use of the singular includes the plural unless specifically stated otherwise. In the application, use of, "or," means, "and/or," unless stated otherwise. Furthermore, use of the term, "including," as well as other forms, such as, "includes," and, "included," is not limiting.

For the purposes of the instant disclosure, "toner," "developer," "toner composition," and "toner particles," may be used interchangeably, and any particular or specific use and meaning will be evident from the context of the sentence, paragraph and the like in which the word or phrase appears.

As used herein, "pH adjuster," means an acid or a base or buffer which may be used to change the pH of a composition (e.g., slurry, resin, aggregate, toner and the like). Such adjusters may include, but are not limited to, sodium hydroxide (NaOH), nitric acid, sodium acetate/acetic acid and the like.

As used herein, "image" includes, but is not limited to, symbols, tracings, blueprints, schematics, graphics, glyphs, dots, formulas, pixels, codes, figures, patterns, including tactile discernable patterns, letters, and numbers As used herein, "hyperpigmented," means a toner having high pigment loading at low toner mass per unit area (TMA) than found in conventional toner, such as to provide a sufficient image reflection optical density of greater than 1.4 when printed and fused on a substrate, such pigment loading chosen so that the ratio of TMA measured for a single color layer in $mg/cm^2$ divided by the volume diameter of the toner particle in microns, is less than about 0.075, in order to meet that required image density.

As used herein, "substrate," means a solid phase or layer that underlies something, or on which some process occurs, in particular, and may include, for example, but is not limited to, paper, rubber, composites, plastic, ceramic, fiber, metal, alloy, glass or combinations thereof.

Resins can be classified generally as amorphous or crystalline. Those terms describe the molecule structure of the solid forms. Crystalline resins comprise molecules or chains which align into an ordered configuration. On the other hand, amorphous resins, some of which are called glasses, lack a long range order that typifies a crystal. Often amorphous resins are clear or transparent, and are hard and brittle, whereas crystalline resins are translucent or opaque.

II. Toner Particles

Toner particles of interest comprise a resin, such as, an acrylate resin, a styrene resin, a polyester resin and so on. In the context of a toner for use with certain imaging devices, the resin can comprise a polymer, such as, a polyester polymer that solidifies to form a particle. A composition may comprise more than one form or sort of polymer, such as, two or more different polymers, such as, two or more different polyester polymers composed of different monomers. The polymer may be an alternating copolymer, a block copolymer, a graft copolymer, a branched copolymer, a crosslinked copolymer and so on.

The toner particle may include other optional reagents, such as, a surfactant, a wax, a shell and so on. The toner composition optionally may comprise inert particles, which may serve as toner particle carriers, which may comprise the resin taught herein. The inert particles may be modified, for example, to serve a particular function. Hence, the surface thereof may be derivatized or the particles may be manufactured for a desired purpose, for example, to carry a charge or to possess a magnetic field.

A. Components

1. Resin

Toner particles of the instant disclosure include a resin forming monomer suitable for use in forming a particulate containing or carrying a colorant of a toner for use in certain imaging devices. The polyester-forming monomer is one that is inducible to form a resin, that is, which reacts, sets or solidifies to form a solid. Such a resin, a plastic, an elastomer and so on, whether naturally occurring or synthetic, is one that may be used in an imaging device. Generally, any suitable monomer or monomers are induced to polymerize to form a polyester resin or a copolymer. Any polyfunctional monomer may be used depending on the particular polyester polymer desired in a toner particle. Hence, bifunctional reagents, trifunctional reagents and so on may be used. One or more reagents that comprise at least three functional groups can be incorporated into a polymer or into a branch to enable branching, further branching and/or crosslinking. Examples of such polyfunctional monomers include 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane and 1,2,7,8-octanetetracarboxylic acid. Polyester resins, for example, may be used for applications requiring low melting temperature. Formed particles may be mixed with other reagents, such as, a colorant, to form a developer.

One, two or more polymers may be used in forming a toner or toner particle. In embodiments where two or more polymers are used, the polymers may be in any suitable ratio (e.g., weight ratio) such as, for instance, with two different polymers, from about 1% (first polymer)/99% (second polymer) to about 99% (first polymer)/1% (second polymer), from about 25% (first polymer)/75% (second polymer) to about 75% (first polymer)/25% (second polymer), in embodiments, from about 10% (first polymer)/90% (second polymer) to about 90% (first polymer)/10% (second polymer) and so on, as a design choice.

The polymer may be present in an amount of from about 65 to about 95% by weight, from 70 to about 90% by weight, from about 75 to about 85% by weight of toner particles on a solids basis.

a. Polyester resins

Suitable polyester resins include, for example, those which are sulfonated, non-sulfonated, crystalline, amorphous, combinations thereof and the like. The polyester resins may be linear, branched, crosslinked, combinations thereof and the like. Polyester resins may include those described, for example, in U.S. Pat. Nos. 6,593,049; 6,830,860; 7,754,406; 7,781,138; 7,749,672; and 6,756,176, the disclosures of each of which hereby is incorporated by reference in entirety.

When a mixture is used, such as, amorphous and crystalline polyester resins, the ratio of crystalline polyester resin to amorphous polyester resin may be in the range from about 1:99 to about 30:70; from about 3:95 to about 25:75; in embodiments, from about 5:95 to about 15:95.

A polyester resin may be obtained synthetically, for example, in an esterification reaction involving a reagent comprising a carboxylic acid group and another reagent comprising an alcohol or an ester. In embodiments, the alcohol reagent comprises two or more hydroxyl groups, in embodiments, three or more hydroxyl groups. In embodiments, the acid comprises two or more carboxylic acid groups, in embodiments, three or more carboxylic acid groups. Reagents comprising three or more functional groups enable, promote or enable and promote polymer branching and crosslinking. In embodiments, a polymer backbone or a polymer branch comprises at least one monomer unit comprising at least one pendant group or side group, that is, the monomer reactant from which the unit was obtained comprises at least three functional groups.

Examples of polyacids or polyesters that may be used for preparing an amorphous polyester resin include terephthalic acid, phthalic acid, isophthalic acid, fumaric acid, trimellitic acid, diethyl fumarate, dimethyl itaconate, cis-1,4-diacetoxy-2-butene, dimethyl fumarate, diethyl maleate, maleic acid, succinic acid, itaconic acid, succinic acid, cyclohexanoic acid, succinic anhydride, dodecylsuccinic acid, dodecylsuccinic anhydride, glutaric acid, glutaric anhydride, adipic acid, pimelic acid, suberic acid, azelaic acid, dodecanedioic acid, dimethyl naphthalenedicarboxylate, dimethyl terephthalate, diethyl terephthalate, dimethylisophthalate, diethylisophthalate, dimethylphthalate, phthalic anhydride, diethylphthalate, dimethylsuccinate, naphthalene dicarboxylic acid, dimer diacid, dimethylfumarate, dimethylmaleate, dimethylglutarate, dimethyladipate, dimethyl dodecylsuccinate and combinations thereof. The organic polyacid or polyester reagent may be present, for example, in an amount from about 40 to about 60 mole % of the resin, in embodiments from about 42 to about 52 mole % of the resin, in embodiments from about 45 to about 50 mole % of the resin, and optionally a second polyacid may be used in an amount from about 0.01 to about 20 mole % of the resin, from about 0.05 to about 15 mole % of the resin, from about 0.1 to about 10 mole % of the resin.

Examples of polyols which may be used in generating an amorphous polyester resin include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene glycol and combinations thereof. The amount of organic polyol may vary, and may be present, for example, in an amount from about 40 to about 60 mole % of the resin, in embodiments from about 42 to about 55 mole % of the resin, in embodiments from about 45 to about 53 mole % of the resin, and a second polyol may be used in an amount from about 0.1 to about 10 mole %, from about 0.05 to about 7 mole %, in embodiments, from about 1 to about 4 mole % of the resin.

Polycondensation catalysts may be used in forming the amorphous (or crystalline) polyester resin, and include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide and stannous oxide, or combinations thereof. Such catalysts may be used in amounts of, for example, from about 0.01 mole % to about 5 mole % based on the starting polyacid or polyester reagent(s) used to generate the polyester resin.

In embodiments, the resin may be a crosslinkable resin. A crosslinkable resin is a resin including a crosslinkable group or groups, such as, a C═C bond or a pendant group or side group, such as, a carboxylic acid group. The resin may be crosslinked, for example, through a free radical polymerization with an initiator.

Examples of amorphous resins which may be used include alkali sulfonated-polyester resins, branched alkali sulfonated-polyester resins, alkali sulfonated-polyimide resins and branched alkali sulfonated-polyimide resins. Alkali sulfonated polyester resins may be useful in embodiments, such as, the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate) and copoly(ethoxylated bisphenol-A-maleate)-copoly (ethoxylated bisphenol-A-5-sulfo-isophthalate), wherein the alkali metal is, for example, a sodium, a lithium or a potassium ion.

In embodiments, an unsaturated amorphous polyester resin may be used as a latex resin. Examples of such resins include those disclosed in U.S. Pat. No. 6,063,827, the disclosure of which is hereby incorporated by reference in entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate) and combinations thereof.

In embodiments, a suitable amorphous resin may include alkoxylated bisphenol A fumarate/terephthalate-based polyester and copolyester resins. In embodiments, a suitable polyester resin may be an amorphous polyester resin, such as, a poly(propoxylated bisphenol A co-fumarate) resin. Examples of such resins and processes for production thereof include those disclosed in U.S. Pat. No. 6,063,827, the disclosure of which is hereby incorporated by reference in entirety.

An example of a linear propoxylated bisphenol A fumarate resin is available under the trade name SPARII from Resana S/A Industrias Quimicas, Sao Paulo Brazil. Other propoxylated bisphenol A fumarate resins that are commercially available include GTUF and FPESL-2 from Kao Corporation, Japan, and EM181635 from Reichhold, Research Triangle Park, North Carolina, and the like.

For forming a crystalline polyester resin, suitable organic polyols include aliphatic polyols with from about 2 to about 36 carbon atoms, such as, 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like, including structural isomers thereof. The aliphatic polyol may be, for example, selected in an amount from about 40 to about 60 mole %, in embodiments, from about 42 to about 55 mole %, in embodiments, from about 45 to about 53 mole %, and a second polyol may be used in an amount from about 0.1 to about 10 mole %, in embodiments, from about 1 to about 4 mole % of the resin.

Examples of organic polyacid or polyester reagents for preparing a crystalline resin include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid (sometimes referred to herein, in embodiments, as cyclohexanedioic acid), malonic acid and mesaconic acid, a polyester or anhydride thereof; and an alkali sulfo-organic polyacid, such as, the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfo-p-hydroxybenzoic acid, N,N-bis(2-hydroxyethyl)-2-amino ethane sulfonate or mixtures thereof. The organic polyacid may be selected in an amount of, for example, in embodiments, from about 40 to about 60 mole %, in embodiments, from about 42 to about 52 mole %, in embodiments, from about 45 to about 50 mole %, and optionally, a second polyacid may be selected in an amount from about 0.01 to about 20 mole % of the resin, from about 0.05 to about 15 mole % of the resin, from about 0.1 to about 10 mole % of the resin.

Specific crystalline resins include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly (hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(ethylene-adipate), alkali copoly(5-sulfoisophthaloyl)-copoly(propylene-adipate), alkali copoly (5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly (propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfoisophthaloyl)-copoly(ethylene-succinate), alkali copoly (5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly (ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(hexylene-adipatenonylene-decanoate), poly(octylene-adipate), and so on, wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly (propylene-sebecamide). Examples of polyimides include poly(ethylene-adipimide), poly(propylene-adipimide), poly (butylene-adipimide), poly(pentylene-adipimide), poly (hexylene-adipimide), poly(octylene-adipimide), poly(ethylene-succinimide), poly(propylene-succinimide) and poly (butylene-succinimide).

Suitable crystalline resins which may be utilized, optionally, in combination with an amorphous resin as described above, include those disclosed in U.S. Pub. No. 2006/0222991, the disclosure of which is hereby incorporated by reference in entirety.

In embodiments, a suitable crystalline resin may include a resin formed of ethylene glycol and a mixture of dodecanedioic acid and fumaric acid co-monomers.

Examples of other suitable resins or polymers which may be utilized in forming a toner include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid) and combinations thereof. The polymer may be, for example, block, random or alternating copolymers.

The crystalline resin may be present, for example, in an amount from about 1 to about 85% by weight of the toner components, in embodiments, from about 2 to about 50% by weight of the toner components, in embodiments, from about 5 to about 15% by weight of the toner components. The crystalline resin may possess various melting points of, for example, from about 30° C. to about 120° C., in embodiments, from about 50° C. to about 90° C., in embodiments, from about 60° C. to about 80° C. The crystalline resin may have a number average molecular weight ($M_n$), as measured by gel permeation chromatography (GPC) of, for example, from about 1,000 to about 50,000, in embodiments, from about 1,500 to about 37,500, in embodiments, from about 2,000 to about 25,000, and a weight average molecular weight ($M_w$) of, for example, from about 2,000 to about 100,000, in embodiments, 2,500 to about 90,000, in embodiments, from about 3,000 to about 80,000, as determined by GPC using polystyrene standards. The molecular weight distribution ($M_w/M_n$) of the crystalline resin may be, for example, from about 1 to about 6, from 2 to about 5, in embodiments, from about 3 to about 4.

b. Catalyst

Condensation catalysts which may be used in the polyester reaction include tetraalkyl titanates; dialkyltin oxides, such as, dibutyltin oxide; tetraalkyltins, such as, dibutyltin dilaurate; dibutyltin diacetate; dibutyltin oxide; dialkyltin oxide hydroxides, such as, butyltin oxide hydroxide; aluminum alkoxides, alkyl zinc, dialkyl zinc, zinc oxide, stannous oxide, stannous chloride, butylstannoic acid or combinations thereof.

Such catalysts may be used in amounts of, for example, from about 0.01 mole % to about 5 mole % based on the amount of starting polyacid, polyol or polyester reagent in the reaction mixture.

Generally, as known in the art, the polyacid/polyester and polyols reagents are mixed together, optionally, with a catalyst, and incubated at an elevated temperature, such as, from about 180° C. or more, from about 190° C. or more, from about 200° C. or more and so on, which may be conducted anaerobically, to enable esterification to occur until equilibrium, which generally yields water or an alcohol, such as, methanol, arising from forming the ester bonds in esterification reactions. The reaction may be conducted under vacuum to promote polymerization. The product is collected by practicing known methods, and may be dried, again, by practicing known methods to yield particulates.

Branching agents may be used, and include, for example, a multivalent polyacid, such as, 1,2,4-benzene-tricarboxylic acid, 1,2,4-cyclohexanetricarboxylic acid, 2,5,7-naphthalenetricarboxylic acid, 1,2,4-naphthalenetricarboxylic acid, 1,2,5-hexanetricarboxylic acid, 1,3-dicarboxyl-2-methyl-2-methylene-carboxylpropane, tetra(methylene-carboxyl) methane, 1,2,7,8-octanetetracarboxylic acid, acid anhydrides thereof, lower alkyl esters thereof and so on. The branching agent may be used in an amount from about 0.01 to about 10 mole % of the resin, from about 0.05 to about 8 mole %, from about 0.1 to about 5 mole % of the resin.

It may be desirable to crosslink the polymer. A suitable resin conducive to crosslinking is one with a reactive group, such as, a C═C bond or with pendant or side groups, such as, a carboxylic acid group. The resin may be crosslinked, for example, through free radical polymerization with an initiator. Suitable initiators include peroxides, such as, organic peroxides or azo compounds, for example diacyl peroxides, such as, decanoyl peroxide, lauroyl peroxide and benzoyl peroxide, ketone peroxides, such as, cyclohexanone peroxide and methyl ethyl ketone, alkyl peroxy esters, such as, tbutyl peroxy neodecanoate, 2,5-dimethyl 2,5-di(2-ethyl hexanoyl peroxy)hexane, tamyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, alkyl peroxides, such as, dicumyl peroxide, 2,5-dimethyl 2,5-di(t-butyl peroxy)hexane, t-butyl cumyl peroxide, bis(t-butyl peroxy)diisopropyl benzene, di-t-butyl peroxide and 2,5-dimethyl 2,5-di(t-butyl peroxy)hexyne-3, alkyl hydroperoxides, such as, 2,5-dihydro peroxy 2,5-dimethyl hexane, cumene hydroperoxide, t-butyl hydroperoxide and t-amyl hydroperoxide, and alkyl peroxyketals, such as, n-butyl 4,4-di(t-butyl peroxy)valerate, 1,1-di(t-butyl peroxy) 3,3,5-trimethyl cyclohexane, 1,1-di(t-butyl peroxy)cyclohexane, 1,1-di (t-amyl peroxy)cyclohexane, 2,2-di(t-butyl peroxy)butane, ethyl 3,3-di(t-butyl peroxy)butyrate and ethyl 3,3-di(t-amyl peroxy)butyrate, azobis-isobutyronitrile, 2,2'-azobis(isobutyronitrile), 2,2'-azobis(2,4-dimethyl valeronitrile), 2,2'-azobis(methyl butyronitrile), 1,1'-azobis(cyano cyclohexane), 1,1-di(t-butyl peroxy)-3,3,5-trimethylcyclohexane, combinations thereof and the like. The amount of initiator used is proportional to the degree of crosslinking, and thus, the gel content of the polyester material. The amount of initiator used may range from, for example, about 0.01 to about 10 weight %, from about 0.05 to about 7.5 weight % of the polyester resin, from about 0.1 to about 5 weight % of the polyester resin. In the crosslinking, it is desirable that substantially all of the initiator be consumed. The crosslinking may be carried out at high temperature, and thus the reaction may be very fast, for example, less than 10 minutes, such as from about 20 seconds to about 2 minutes residence time.

The polymer reagent then may be incorporated with, for example, other reagents suitable for making a toner particle, such as, a colorant and/or a wax, and processed in a known manner to produce toner particles.

2. Colorants

Suitable colorants include those comprising carbon black, such as, REGAL 330® and Nipex 35; magnetites, such as, Mobay magnetites, MO8029™ and MO8060™; Columbian magnetites, MAPICO® BLACK; surface-treated magnetites; Pfizer magnetites, CB4799™, CB5300™, CB5600™ and MCX6369™; Bayer magnetites, BAYFERROX 8600™ and 8610™; Northern Pigments magnetites, NP604™ and NP608™; Magnox magnetites, TMB-100™ or TMB104™; and the like.

Colored pigments, such as, cyan, magenta, yellow, red, orange, green, brown, blue or mixtures thereof may be used. The additional pigment or pigments may be used as water-based pigment dispersions.

Examples of pigments include SUNSPERSE 6000, FLEXIVERSE and AQUATONE, water-based pigment dispersions from SUN Chemicals; HELIOGEN BLUE L6900™, D6840™, D7080™, D7020™ PYLAM OIL BLUE™, PYLAM OIL YELLOW™ and PIGMENT BLUE I™ available from Paul Uhlich & Company, Inc.; PIGMENT VIOLET I™ PIGMENT RED 48™, LEMON CHROME YELLOW DCC 1O26™, TOLUIDINE RED™ and BON RED C™ available from Dominion Color Corporation, Ltd., Toronto, Ontario; NOVAPERM YELLOW FGL™ and HOSTAPERM PINK E™ from Hoechst; CINQUASIA MAGENTA™ available from E.I. DuPont de Nemours & Co., and the like.

Examples of magenta pigments include 2,9-dimethyl-substituted quinacridone, an anthraquinone dye identified in the Color Index as CI-60710, CI Dispersed Red 15, a diazo dye identified in the Color Index as CI-26050, CI Solvent Red 19, and the like.

Illustrative examples of cyan pigments include copper tetra (octadecylsulfonamido) phthalocyanine, a copper phthalocyanine pigment listed in the Color Index as CI-74160, CI Pigment Blue, Pigment Blue 15:3, Pigment Blue 15:4, an Anthrazine Blue identified in the Color Index as CI-69810, Special Blue X-2137, and the like.

Illustrative examples of yellow pigments are diarylide yellow 3,3-dichlorobenzidene acetoacetanilide, a monoazo pigment identified in the Color Index as CI 12700, CI Solvent Yellow 16, a nitrophenyl amine sulfonamide identified in the Color Index as Foron Yellow SE/GLN, CI Disperse Yellow 3,2,5-dimethoxy-4-sulfonanilide phenylazo-4'-chloro-2,5-dimethoxy acetoacetanilide and Permanent Yellow FGL.

Other known colorants may be used, such as, Levanyl Black ASF (Miles, Bayer) and Sunsperse Carbon Black LHD 9303 (Sun Chemicals), and colored dyes, such as, Neopen Blue (BASF), Sudan Blue OS (BASF), PV Fast Blue B2G 01 (American Hoechst), Sunsperse Blue BHD 6000 (Sun Chemicals), Irgalite Blue BCA (CibaGeigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), SUCD-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like. Other pigments that may be used, and which are commercially available include various pigments in the color classes, Pigment Yellow 74, Pigment Yellow 14, Pigment Yellow 83, Pigment Orange 34, Pigment Red 238, Pigment Red 122, Pigment Red 48:1, Pigment Red 269, Pigment Red 53:1, Pigment Red 57:1, Pigment Red 83:1, Pigment Violet 23, Pigment Green 7 and so on, and combinations thereof.

The colorant, for example, furnace carbon black, cyan, magenta and/or yellow colorant, may be incorporated in an amount sufficient to impart the desired color to the toner. In general, pigment or dye, may be employed in an amount ranging from about 2% to about 50% by weight of the toner particles on a solids basis, from about 5% to about 40% by weight or from about 10% to about 30% by weight.

In embodiments, the colorant, for example, a furnace carbon black (e.g., but not limited to, Nipex 35), may be replaced using a thermal carbon black.

In embodiments, more than one colorant may be present in a toner particle. For example, two colorants may be present in a toner particle, such as, a first colorant of pigment blue, may be present in an amount ranging from about 2% to about 10% by weight of the toner particle on a solids basis, from about 3% to about 8% by weight or from about 5% to about 10% by weight; with a second colorant of pigment yellow that may be present in an amount ranging from about 5% to about 20% by weight of the toner particle on a solids basis, from about 6% to about 15% by weight or from about 10% to about 20% by weight and so on.

3. Optional Components a. Surfactants

In embodiments, toner compositions may be in dispersions including surfactants. Emulsion aggregation methods where the polymer and other components of the toner are in combination may employ one or more surfactants to form an emulsion.

One, two or more surfactants may be used. The surfactants may be selected from ionic surfactants and nonionic surfactants, or combinations thereof. Anionic surfactants and cationic surfactants are encompassed by the term, "ionic surfactants."

In embodiments, the surfactant or the total amount of surfactants may be used in an amount of from about 0.01% to about 5% by weight of the toner forming composition, from about 0.75% to about 4% by weight of the toner-forming composition, in embodiments, from about 1% to about 3% by weight of the toner-forming composition.

Examples of nonionic surfactants include, for example, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether and dialkylphenoxy poly(ethyleneoxy)ethanol, for example, available from Rhone-Poulenc as IGEPAL CA-210™, IGEPAL CA520™, IGEPAL CA-720™, IGEPAL CO-890™, IGEPAL CO-720™, IGEPAL CO-290™, IGEPAL CA-210™, ANTAROX890™ and ANTAROX$^{897}$™. Other examples of suitable nonionic surfactants include a block copolymer of polyethylene oxide and polypropylene oxide, including those commercially available as SYNPERONIC® PR/F, in embodiments, SYNPERONIC® PR/F 108; and a DOWFAX, available from The Dow Chemical Corp.

Anionic surfactants include sulfates and sulfonates, such as, sodium dodecylsulfate (SDS), sodium dodecylbenzene sulfonate, sodium dodecylnaphthalene sulfate and so on; dialkyl benzenealkyl sulfates; acids, such as, palmitic acid, and NEOGEN or NEOGEN SC obtained from Daiichi Kogyo Seiyaku, and so on, combinations thereof and the like. Other suitable anionic surfactants include, in embodiments, alkyldiphenyloxide disulfonates or TAYCA POWER BN2060 from Tayca Corporation (Japan), which is a branched sodium dodecyl benzene sulfonate. Combinations of those surfactants and any of the foregoing nonionic surfactants may be used in embodiments.

Examples of cationic surfactants include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, trimethyl ammonium bromides, halide salts of quarternized polyoxyethylalkylamines, dodecylbenzyl triethyl ammonium chlorides, MIRAPOL® and ALKAQUAT® available from Alkaril Chemical Company, SANISOL® (benzalkonium chloride) available from Kao Chemicals and the like, and mixtures thereof, including, for example, a nonionic surfactant as known in the art or provided hereinabove.

b. Waxes

The toners of the instant disclosure, optionally, may contain a wax, which may be either a single type of wax or a mixture of two or more different types of waxes (hereinafter identified as, "a wax"). A wax may be added to a toner formulation or to a developer formulation, for example, to improve particular toner properties, such as, toner particle shape, charging, fusing characteristics, gloss, stripping, offset properties and the like. Alternatively, a combination of waxes may be added to provide multiple properties to a toner or a developer composition. A wax may be included as, for example, a fuser roll release agent.

The wax may be combined with the resin-forming composition for forming toner particles. When included, the wax may be present in an amount of, for example, from about 1 wt % to about 25 wt % of the toner particles, from about 2.5 wt % to about 22.5 wt % of the toner particles, in embodiments, from about 5 wt % to about 20 wt % of the toner particles.

Waxes that may be selected include waxes having, for example, a weight average molecular weight of from about 500 to about 20,000, from about 750 to about 15,000, in embodiments, from about 1,000 to about 10,000. Waxes that may be used include, for example, polyolefins, such as, polyethylene, polypropylene and polybutene waxes, such as, those that are commercially available, for example, POLYWAX™ polyethylene waxes from Baker Petrolite, wax emulsions available from Michaelman, Inc. or Daniels Products Co., EPOLENE N15™ which is commercially available from Eastman Chemical Products, Inc., VISCOL 550P™, a low weight average molecular weight polypropylene available from Sanyo Kasei K.K.; plant-based waxes, such as carnauba wax, rice wax, candelilla wax, sumac wax and jojoba oil; animal-based waxes, such as, beeswax; mineral-based waxes and petroleum-based waxes, such as, montan wax, ozokerite, ceresin wax, paraffin wax, microcrystalline wax and Fischer-Tropsch waxes; ester waxes obtained from higher fatty acids and higher alcohols, such as, stearyl stearate and behenyl behenate; ester waxes obtained from higher fatty acids and monovalent or multivalent lower alcohols, such as, butyl stearate, propyl oleate, glyceride monostearate, glyceride distearate and pentaerythritol tetrabehenate; ester waxes obtained from higher fatty acids and multivalent alcohol multimers, such as diethyleneglycol monostearate, dipropyleneglycol distearate, diglyceryl distearate and triglyceryl tetrastearate; sorbitan higher fatty acid ester waxes, such as sorbitan monostearate; cholesterol higher fatty acid ester waxes, such as, cholesteryl stearate, and so on.

Examples of functionalized waxes that may be used include, for example, amines and amides, for example, AQUA SUPERSLIP 6550™ and SUPERSLIP 6530™ available from Micro Powder Inc.; fluorinated waxes, for example, POLYFLUO 190™, POLYFLUO200™, POLYSILK 19™ and POLYSILK 14™ available from Micro Powder Inc.; mixed fluorinated amide waxes, for example, MICROSPERSION 19™ also available from Micro Powder Inc.; imides, esters, quaternary amines, carboxylic acids, acrylic polymer emulsions, for example, JONCRYL 74™, 89™, 130™, 537™ and 538™ available from SC Johnson Wax; and chlorinated polypropylenes and polyethylenes available from Allied Chemical, Petrolite Corp. and SC Johnson. Mixtures and combinations of the foregoing waxes also may be used in embodiments.

c. Aggregating Factor

An aggregating factor may be an inorganic cationic coagulant, such as, for example, polyaluminum chloride (PAC), polyaluminum sulfosilicate (PASS), aluminum sulfate, zinc sulfate, magnesium sulfate, chlorides of magnesium, calcium, zinc, beryllium, aluminum, sodium, other metal halides including monovalent and divalent halides.

The aggregating factor may be present in an emulsion in an amount of from, for example, from about 0.01 to about 10 wt %, from about 0.025 to about 7.5 wt %, from about 0.05 to about 5 wt % based on the total solids in the toner.

The aggregating factor may also contain minor amounts of other components, for example, nitric acid.

In embodiments, a sequestering agent or chelating agent may be introduced after aggregation is complete to sequester or extract a metal complexing ion, such as, aluminum from the aggregation process. Thus, the sequestering, chelating or complexing agent used after aggregation is complete may comprise an organic complexing component, such as, ethylenediaminetetraacetic acid (EDTA), gluconal, hydroxyl-2,2' iminodisuccinic acid (HIDS), dicarboxylmethyl glutamic acid (GLDA), methyl glycidyl diacetic acid (MGDA), hydroxydiethyliminodiacetic acid (HIDA), sodium gluconate, potassium citrate, sodium citrate, nitrotriacetate salt, humic acid, fulvic acid; salts of EDTA, such as, alkali metal salts of EDTA, tartaric acid, gluconic acid, oxalic acid, polyacrylates, sugar acrylates, citric acid, polyasparic acid, diethylenetriamine pentaacetate, 3-hydroxy-4-pyridinone, dopamine, eucalyptus, iminodisuccinic acid, ethylenediaminedisuccinate, polysaccharide, sodium ethylenedinitrilotetraacetate, thiamine pyrophosphate, farnesyl pyrophosphate, 2-aminoethylpyrophosphate, hydroxylethylidene-1,1-diphosphonic acid, aminotrimethylenephosphonic acid, diethylene triaminepentamethylene phosphonic acid, ethylenediamine tetramethylene phosphonic acid, and mixtures thereof.

d. Surface Additive

External additives may be added to the toner particle surface by any suitable procedure such as those well known in the art. For example, suitable surface additives that may be used are one or more of $SiO_2$, metal oxides such as, for example, cerium oxide, $TiO_2$ and aluminum oxide, polymethyl methacrylate (PMMA) and a lubricating agent such as, for example, a metal salt of a fatty acid (for example, zinc stearate (ZnSt), calcium stearate) or long chain alcohols such as UNILIN 700. $SiO_2$ and $TiO_2$ may be surface treated with compounds including DTMS (dodecyltrimethoxysilane) or HMDS (hexamethyldisilazane). Examples of additives are a silica coated with a mixture of HMDS and aminopropyltriethoxysilane; a silica coated with PDMS (polydimethylsiloxane); a silica coated with octamethylcyclotetrasiloxane; a silica coated with dimethyldichlorosilane; a silica coated with an amino functionalized organopolysiloxane and so on. DTMS silica, obtained from Cabot Corporation, is comprised of a fumed silica, for example, silicon dioxide core L90, coated with DTMS.

The metal oxide may be prepared by any known method, such as, a fumed silica process, which generally produces smaller sized particles. Toner particles can include larger sized silica particles, for example, colloidal silica or sol-gel silica particles having a size of from about 100 to about 150 nm, from about 80 to 200 nm on the external surfaces thereof. Sol-gel silicas are silicas can be synthesized by the controlled hydrolysis and condensation of tetraethoxysilane. The sol-gel process typically is carried out in alcohol solvents with added homopolymer solutes to control the structure of the precipitated silicon dioxide product. Examples of alcohol solvents used in the sol-gel process include methanol, ethanol and butanol.

Such silica particles can stabilize toner charge and can reduce impaction os smaller sized particles and materials, such as, smaller sized metal oxide surface additives, such as, silica and titania into the toner particles, see, for example, U.S. Pat. No. 6,610,452, incorporated herein by reference in entirety. Some sol-gel silicas are used in toners, however, the synthesis thereof can be involved, complicated, employ costly reagents and so on.

Zinc stearate also may be used as an external additive. Calcium stearate and magnesium stearate may provide similar functions. Zinc stearate may have an average primary particle size in the range of, for example, from about 500 nm to about 700 nm, such as, from about 500 nm to about 600 nm or from about 550 nm to about 650 nm.

To minimize dielectric loss, to increase charge or both, for example, in hyperpigmented toners, toners comprising a black pigment or both, and so on, a silica comprising a surface treatment with an alkyl silane (AS) is used. Alkyl can comprise an aliphatic hydrocarbon, which can be branched, can be substituted and can be unsaturated at one or more bonds, with a length of 1 to about 30 carbon atoms, from about 3 to about 20 carbons, from about 5 to about 15 carbons, such as, hexyl, octyl and decyl.

The molecule used to treat the silica surface can comprise any of a variety of reactive functional groups to affix the alkyl group to the silica surface. For example, a functional group comprises an anionic character can be used, such as, a halogen, an alkoxy group, an amino group and so on. For example, halogen can be, as known in the art, for example, Cl, Br and so on. An amino group can be a primary amine, secondary amine and so on. Alkoxy comprises an alkyl as described herein, in embodiments, the chain length is from 1 to about 8 carbons, from about 2 to about 6 carbons, from about 3 to about 5 carbons.

An example is TG-C190 of the CAB-O-SIL™ Division of Cabot, which is a sol-gel silica having a surface treated with octyl triethoxy silane (OTS). In embodiments, a toner composition comprising AS-treated silica, such as, OTS— treated sol-gel silica exhibits improved second transfer efficiency and image quality (IQ) in the A zone compared to a toner composition comprising an additive package containing, for example, an HMDS-treated sol-gel silica. (HMDS confers a strong negative charge on a silica.) Such silicas may have an average primary particle size, measured in diameter, in the range of, for example, from about 80 to about 200 nm, from about 100 nm to about 175 nm, from about 105 nm to about 150 nm, from about 110 nm to about 130 nm.

Alkoxy comprises an alkyl as described herein, in embodiments, the chain length is from 1 to about 8 carbons, from about 2 to about 6 carbons, from about 3 to about 5 carbons. An example is TG-C190 of the CAB-O-SIL™ Division of Cabot, which is a silica having a surface treated with octyl triethoxy silane (OTS). In embodiments, a toner composition comprising AA-treated silica, such as, OTS— treated sol-gel silica exhibits improved second transfer efficiency and image quality (IQ) in the A zone compared to a toner composition comprising an additive package containing an HMDS-treated sol-gel silica. Such silicas may have an average primary particle size, measured in diameter, in the range of, for example, from about 5 to about 600 nm, such as from about 10 nm to about 500 nm, such as, from about 20 nm to about 400 nm, from about 30 nm to about 300 nm. The fumed silicas tend to be smaller in size in the ranges above and the sol-gel silicas tend to be larger in size in the ranges above.

Others additives may include titania comprised of a crystalline titanium dioxide core coated with DTMS and titania comprised of a crystalline titanium dioxide core coated with DTMS. The titania also may be untreated, for example P-25 from Nippon AEROSIL Co., Ltd. Zinc stearate also may be used as an external additive, the zinc stearate providing lubricating properties. Zinc stearate provides developer conductivity and tribo enhancement, both due to the lubricating nature thereof. In addition, zinc stearate may enable higher toner charge and charge stability by increasing the number of contacts between toner and carrier particles. Calcium stearate and magnesium stearate provide similar functions.

In embodiments, the toner particles may be mixed with one or more of silicon dioxide or silica ($SiO_2$), titania or titanium dioxide ($TiO_2$) and/or cerium oxide. In embodiments, a silica, a titania and a cerium are present. Silica may have an average primary particle size, measured in diameter, in the range of, for example, from about 5 nm to about 50 nm, such as, from about 10 nm to about 40 nm or from about 20 nm to about 30 nm. The silica may have an average primary particle size, measured in diameter, in the range of, for example, from about 100 nm to about 200 nm, such as, from about 110 nm to about 150 nm or from about 125 nm to about 145 nm The titania may have an average primary particle size in the range of, for example, about 5 nm to about 50 nm, such as, from about 7 nm to about 40 nm or from about 10 nm to about 30 nm. The cerium oxide may have an average primary particle size in the range of, for example, about 5 nm to about 50 nm, such as, from about 7 nm to about 40 nm or from about 10 nm to about 30 nm.

In embodiments, an additive package may contain one or more additives which exhibit low dielectric loss, wherein the primary particles size of said one or more additives is greater than about 30 nm, is greater than about 40 nm, is greater than about 50 nm, is greater than about 60 nm, and wherein said toner exhibits high pigment loading at reduced toner mass per unit area (TMA).

In embodiments, an additive package may include AEROSIL® RY50L (Evonik) (1.29%), fumed silica AEROSIL® RX50 (Evonik) (0.86%), silica TG-C190 (Cabot) (1.66%), isobutyltrimethoxysilane (STT100H) (Titan Kogyo) (0.88%), cerium oxide (E10) (Mitsui Mining and Smelting) (0.275%), zinc stearate (NOF) (0.18%) and polymethylmethacarylate (PMMA) fines (MP116CF) (Soken) (0.50%).

In one embodiment, one or more high dielectric loss additives in an additive package are replaced by one or more low dielectric loss additives. Thus, for example, in the embodiment above, a silica surface-treated with HMDS is replaced with a silica surface-treated with OTS, a silica with low dielectric loss.

In embodiments, an additive package is disclosed where all additives exhibit low dielectric loss. In embodiments, the average of the volume fraction contribution to dielectric loss of each of the surface additives in the additive package is between about 0 to about 60, about 0 to about 40, about 0 to about 30, about 5 to about 25, about 5 to about 20. In other embodiments the average of the volume fraction contributions to dielectric loss of all of the surface additives in the additive package is less than about 60, is less than about 40, is less than about 30, is less than about 20, is less than about 10.

In embodiments, for each additive in the surface additive package, the volume fraction of a surface additive compared to the total volume of the additives in the additive package, multiplied by the dielectric loss of that surface additive, is less than about 60, is less than about 40, is less than about 30, is less than about 20, is less than about 10.

In some embodiments, the dielectric loss of the toner containing the additive packages as disclosed herein exhibits an aggregate dielectric loss, as calculated herein as the sum of the average volume contribution of each additive, of less than 200, less than about 175, less than about 150, less than about 100, less than about 75. The dielectric loss of any one compound or additive is obtained as taught herein or as known in the art.

e. Carrier

Carrier particles include those that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, nickel berry carriers as disclosed in U.S. Pat. No. 3,847,604, the entire disclosure of which hereby is incorporated herein by reference, comprised of nodular carrier beads of nickel, characterized by surfaces of reoccurring recesses and protrusions thereby providing particles with a relatively large external area, those disclosed in U.S. Pat. Nos. 4,937,166 and 4,935,326, the disclosures of which are hereby incorporated herein by reference, and so on. In embodiments, the carrier particles may have an average particle size of, for example, from about 20 to about 85 μm, such as, from about 30 to about 60 μm, or from about 35 to about 50 μm.

B. Toner Particle Preparation

1. Method a. Particle Formation

The toner particles may be prepared by any method within the purview of one skilled in the art, for example, any of the emulsion/aggregation methods may be used with a polyester resin and the thermal carbon black of interest. However, any suitable method of preparing toner particles may be used, including chemical processes, such as, suspension and encapsulation processes disclosed, for example, in U.S. Pat. Nos. 5,290,654 and 5,302,486, the disclosures of each of which are hereby incorporated by reference in entirety; by conventional granulation methods, such as, jet milling; pelletizing slabs of material; other mechanical processes; any process for producing nanoparticles or microparticles; and so on.

In embodiments relating to an emulsification/aggregation process, a resin may be dissolved in a solvent, and may be mixed into an emulsion medium, for example water, such as, deionized water, optionally containing a stabilizer, and optionally a surfactant. Examples of suitable stabilizers include water-soluble alkali metal hydroxides, such as, sodium hydroxide, potassium hydroxide, lithium hydroxide, beryllium hydroxide, magnesium hydroxide, calcium hydroxide or barium hydroxide; ammonium hydroxide; alkali metal carbonates, such as, sodium bicarbonate, lithium bicarbonate, potassium bicarbonate, lithium carbonate, potassium carbonate, sodium carbonate, beryllium carbonate, magnesium carbonate, calcium carbonate, barium carbonate or cesium carbonate; or mixtures thereof. When a stabilizer is used, the stabilizer may be present in amounts of from about 0.1% to about 5%, from about 0.5% to about 3% by weight of the resin. When such salts are added to the composition as a stabilizer, in embodiments, incompatible metal salts are not present in the composition, for example, a composition may be completely or essentially free of zinc and other incompatible metal ions, for example, Ca, Fe, Ba etc., that form water-insoluble salts. The term, "essentially free," refers, for example, to the incompatible metal ions as present at a level of less than about 0.01%, less than about 0.005% or less than about 0.001%, by weight of the wax and resin. The stabilizer may be added to the mixture at ambient temperature, or may be heated to the mixture temperature prior to addition.

Optionally, a surfactant may be added to the aqueous emulsion medium, for example, to afford additional stabilization to the resin or to enhance emulsification of the resin. Suitable surfactants include anionic, cationic and nonionic surfactants as taught herein.

Following emulsification, toner compositions may be prepared by aggregating a mixture of a resin, a pigment, an optional wax and any other desired additives in an emulsion, optionally, with surfactants as described above, and then optionally coalescing the aggregate mixture. A mixture may be prepared by adding an optional wax or other materials, which may also be optionally in a dispersion, including a surfactant, to the emulsion comprising a resin-forming material and a pigments, which may be a mixture of two or more emulsions containing the requisite reagents. The pH of the resulting mixture may be adjusted with an acid, such as, for example, acetic acid, nitric acid or the like. In embodiments, the pH of the mixture may be adjusted to from about 2 to about 4.5.

Additionally, in embodiments, the mixture may be homogenized. If the mixture is homogenized, mixing may be at from about 600 to about 4,000 rpm. Homogenization may be by any suitable means, including, for example, an IKA ULTRA TURRAX T50 probe homogenizer.

b. Aggregation

Following preparation of the above mixture, often, it is desirable to form larger particles or aggregates, often sized in micrometers, of the smaller particles from the initial polymerization reaction, often sized in nanometers. An aggregating factor may be added to the mixture. Suitable aggregating factors include, for example, aqueous solutions of a divalent cation, a multivalent cation or a compound comprising same.

The aggregating factor, as provided above, may be, for example, a polyaluminum halide, such as, polyaluminum chloride (PAC) or the corresponding bromide, fluoride or iodide; a polyaluminum silicate, such as, polyaluminum sulfosilicate (PASS); or a water soluble metal salt, including, aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate or combinations thereof.

In embodiments, the aggregating factor may be added to the mixture at a temperature that is below the glass transition temperature ($T_g$) of the resin or of a polymer.

The aggregating factor may be added to the mixture components to form a toner in an amount of, for example, from about 0.1 part per hundred (pph) to about 1 pph, in embodiments, from about 0.25 pph to about 0.75 pph, in embodiments, about 0.5 pph of the reaction mixture.

To control aggregation of the particles, the aggregating factor may be metered into the mixture over time. For example, the factor may be added incrementally into the mixture over a period of from about 5 to about 240 minutes, in embodiments, from about 30 to about 200 minutes.

Addition of the aggregating factor also may be done while the mixture is maintained under stirred conditions, in embodiments, from about 50 rpm to about 1,000 rpm, in embodiments, from about 100 rpm to about 500 rpm; and at a temperature that is below the $T_g$ of the resin or polymer, in embodiments, from about 30° C. to about 90° C., in embodiments, from about 35° C. to about 70° C. The growth and shaping of the particles following addition of the aggregation factor may be accomplished under any suitable condition(s).

The particles may be permitted to aggregate until a predetermined desired particle size is obtained. Particle size may be monitored during the growth process. For example, samples may be taken during the growth process and analyzed, for example, with a COULTER COUNTER, for average particle size. The aggregation thus may proceed by maintaining the mixture, for example, at elevated temperature, or slowly raising the temperature, for example, from about 40° C. to about 100° C., and holding the mixture at that temperature for from about 0.5 hours to about 6 hours, in embodiments, from about hour 1 to about 5 hours, while maintaining stirring, to provide the desired aggregated particles. Once the predetermined desired particle size is attained, the growth process is halted.

The characteristics of the toner particles may be determined by any suitable technique and apparatus. Volume average particle diameter and geometric standard deviation may be measured using an instrument, such as, a Beckman Coulter MULTISIZER 3, operated in accordance with the instructions of the manufacturer. Representative sampling may occur by taking a sample, filtering through a 25 μm membrane, diluting in an isotonic solution to obtain a concentration of about 10% and then reading the sample, for example, in a Beckman Coulter MULTISIZER 3.

The growth and shaping may be conducted under conditions in which aggregation occurs separate from coalescence. For separate aggregation and coalescence stages, the aggregation process may be conducted under shearing conditions at an elevated temperature, for example, of from about 40° C. to about 90° C., in embodiments, from about 45° C. to about 80° C., which may be below the $T_g$ of the resin or a polymer.

In embodiments, the aggregate particles may be of a size of less than about 3 μm, in embodiments from about 2 μm to about 3 μm, in embodiments from about 2.5 μm to about 2.9 μm.

In embodiments, after aggregation, but prior to coalescence, a resin coating may be applied to the aggregated particles to form a shell thereover. Any resin described herein or as known in the art may be used as the shell. In embodiments, a polyester amorphous resin latex as described herein may be included in the shell. In embodiments, a polyester amorphous resin latex described herein may be combined with a different resin, and then added to the particles as a resin coating to form a shell.

A shell resin may be applied to the aggregated particles by any method within the purview of those skilled in the art. In embodiments, the resins used to form the shell may be in an emulsion, optionally including any surfactant described herein. The emulsion possessing the resins may be combined with the aggregated particles so that the shell forms over the aggregated particles.

The formation of the shell over the aggregated particles may occur while heating to a temperature from about 30° C. to about 80° C., in embodiments from about 35° C. to about 70° C. The formation of the shell may take place for a period of time from about 5 minutes to about 10 hours, in embodiments from about 10 minutes to about 5 hours.

The shell may be present in an amount from about 1% by weight to about 80% by weight of the toner components, in embodiments from about 10% by weight to about 40% by weight of the toner components, in embodiments from about 20% by weight to about 35% by weight of the toner components.

c. Coalescence

Following aggregation to a desired particle size and application of any optional shell, the particles then may be coalesced to a desired final shape, such as, a circular shape, for example, to correct for irregularities in shape and size, the coalescence being achieved by, for example, heating the mixture to a temperature from about 45° C. to about 100° C., in embodiments from about 55° C. to about 99° C., which may be at or above the $T_g$ of the resins used to form the toner particles, and/or reducing the stirring, for example to from about 1000 rpm to about 100 rpm, in embodiments from about 800 rpm to about 200 rpm. Coalescence may be conducted over a period from about 0.01 to about 9 hours, in embodiments from about 0.1 to about 4 hours, see, for example, U.S. Pat. No. 7,736,831.

After aggregation and/or coalescence, the mixture may be cooled to room temperature, such as, from about 20° C. to about 25° C. The cooling may be rapid or slow, as desired. A suitable cooling method may include introducing cold water to a jacket around the reactor. After cooling, the toner particles optionally may be washed with water and then dried. Drying may be by any suitable method, including, for example, freeze-drying.

Optionally, a coalescing agent may be used. Examples of suitable coalescence agents include, but are not limited to, benzoic acid alkyl esters, ester alcohols, glycol/ether-type solvents, long chain aliphatic alcohols, aromatic alcohols, mixtures thereof and the like. Examples of benzoic acid alkyl esters include those where the alkyl group, which may be straight or branched, substituted or unsubstituted, has from about 2 to about 30 carbon atoms, such as decyl or isodecyl benzoate, nonyl or isononyl benzoate, octyl or isooctyl benzoate, 2-ethylhexyl benzoate, tridecyl or isotridecyl benzoate, 3,7-dimethyloctyl benzoate, 3,5,5-trimethylhexyl benzoate, mixtures thereof and the like. Examples of such benzoic acid alkyl esters include VELTA® 262 (isodecyl benzoate) and VELTA® 368 (2-ethylhexyl benzoate) available from Velsicol Chemical Corp. Examples of ester alcohols include hydroxyalkyl esters of alkanoic acids, where the alkyl group, which may be straight or branched, substituted or unsubstituted, and may have from about 2 to about 30 carbon atoms, such as, 2,2,4-trimethylpentane-1,3-diol monoisobutyrate. An example of an ester alcohol is TEXANOL® (2,2,4-trimethylpentane-1,3-diol monoisobutyrate) available from Eastman Chemical Co. Examples of glycol/ether-type solvents include diethylene glycol monomethylether acetate, diethylene glycol monobutylether acetate, butyl carbitol acetate (BCA) and the like. Examples of long chain aliphatic alcohols include those where the alkyl group is from about 5 to about 20 carbon atoms, such as, ethylhexanol, octanol, dodecanol and the like. Examples of aromatic alcohols include benzyl alcohol and the like.

In embodiments, the coalescence agent (or coalescing agent or coalescence aid agent) evaporates during later stages of the emulsion/aggregation process, such as, during a second heating step, that is, generally above the $T_g$ of the resin or a polymer. The final toner particles are thus, free of, or essentially or substantially free of any remaining coalescence agent. To the extent that any remaining coalescence agent may be present in a final toner particle, the amount of remaining coalescence agent is such that presence thereof does not affect any properties or the performance of the toner or developer.

The coalescence agent may be added prior to the coalescence or fusing step in any desired or suitable amount. For example, the coalescence agent may be added in an amount of from about 0.01 to about 10% by weight, based on the solids content in the reaction medium, or from about 0.05, or from about 0.1%, to about 0.5 or to about 3.0% by weight, based on the solids content in the reaction medium. Of course, amounts outside those ranges may be used, as desired.

In embodiments, the coalescence agent may be added at any time between aggregation and coalescence, although in some embodiments it may be desirable to add the coalescence agent after aggregation is, "frozen," or completed, for example, by adjustment of pH, for example, by addition, for example, of base.

Coalescence may proceed and be accomplished over a period of from about 0.1 to about 9 hours, in embodiments, from about 0.5 to about 4 hours.

After coalescence, the mixture may be cooled to room temperature, such as, from about 20° C. to about 25° C. The cooling may be rapid or slow, as desired. A suitable cooling method may include introducing cold water in a jacket around the reactor. After cooling, the toner particles optionally may be washed with water and then dried. Drying may be accomplished by any suitable method for drying including, for example, freeze drying.

d. Shells

In embodiments, an optional shell may be applied to the formed toner particles, aggregates or coalesced particles. Any polymer, including those described above as suitable for the core, may be used for the shell. The shell polymer may be applied to the particles or aggregates by any method within the purview of those skilled in the art.

In embodiments, an amorphous polyester resin may be used to form a shell over the particles or aggregates to form toner particles or aggregates having a coreshell configuration. In some embodiments, a low molecular weight amorphous polyester resin may be used to form a shell over the particles or aggregates.

The shell polymer may be present in an amount of from about 10% to about 32% by weight of the toner particles or aggregates, from about 18% to about 31% by weight of the toner particles or aggregates in embodiments, from about 24% to about 30% by weight of the toner particles or aggregates.

Once the desired final size of the toner particles or aggregates is achieved, the pH of the mixture may be adjusted with base to a value of from about 6 to about 10, from about 6.1 to about 8.5, in embodiments, from about 6.2 to about 7. The adjustment of pH may be used to freeze, that is, to stop, toner particle growth. The base used to stop toner particle growth may be, for example, an alkali metal hydroxide, such as, for example, sodium hydroxide, potassium hydroxide, ammonium hydroxide, combinations thereof and the like. In embodiments, EDTA may be added to assist adjusting the pH to the desired value.

The base may be added in amounts from about 2 to about 25% by weight of the mixture, in embodiments, from about 4 to about 10% by weight of the mixture. Following aggregation to the desired particle size, with the formation of an optional shell as described above, the particles then may be coalesced to the desired final shape, the coalescence being achieved by, for example, heating the mixture to a temperature of from about 55° C. to about 100° C., in embodiments, from about 65° C. to about 75° C., in embodiments, about 70° C., which may be below the melting point of the resin or polymer(s) to prevent plasticization. Higher or lower temperatures may be used, it being understood that the temperature is a function of the polymer(s) used for the core and/or shell.

e. Optional Additives

In embodiments, the toner particles also may contain other optional additives.

i. Charge Additives

The toner may include any known charge additives in amounts of from about 0.1 to about 10 weight %, in embodiments, of from about 0.5 to about 7 weight % of the toner. Examples of such charge additives include alkyl pyridinium halides, bisulfates, the charge control additives of U.S. Pat. Nos. 3,944,493; 4,007,293; 4,079,014; 4,394,430; and 4,560,635, the disclosure of each of which hereby is incorporated by reference in entirety, negative charge enhancing additives, such as, aluminum complexes, and the like.

Charge enhancing molecules may be used to impart either a positive or a negative charge on a toner particle. Examples include quaternary ammonium compounds, see, for example, U.S. Pat. No. 4,298,672, organic sulfate and sulfonate compounds, see for example, U.S. Pat. No. 4,338,390, cetyl pyridinium tetrafluoroborates, distearyl dimethyl ammonium methyl sulfate, aluminum salts and so on.

Such enhancing molecules may be present in an amount of from about 0.1 to about 10% or from about 1 to about 3% by weight.

ii. Surface Modifications

Surface additives may be added to the toner compositions of the present disclosure, for example, after washing or drying. Examples of such surface additives include, for example, one or more of a metal salt, a metal salt of a fatty acid, a colloidal silica, a metal oxide, such as, $TiO_2$ (for example, for improved RH stability, tribo control and improved development and transfer stability), an aluminum oxide, a cerium oxide, a strontium titanate, $SiO_2$, mixtures thereof and the like. Examples of such additives include those disclosed in U.S. Pat. Nos. 3,590,000; 3,720,617; 3,655,374; and 3,983,045, the disclosures of each of which are hereby incorporated by reference in entirety.

Surface additives may be used in an amount of from about 0.1 to about 10 wt %, from about 0.25 to about 8.5 wt %, from about 0.5 to about 7 wt % of the toner.

Other surface additives include lubricants, such as, a metal salt of a fatty acid (e.g., zinc or calcium stearate) or long chain alcohols, such as, UNILIN 700 available from Baker Petrolite and AEROSIL R972® available from Degussa. The coated silicas of U.S. Pat. Nos. 6,190,815 and 6,004,714, the disclosures of each of which hereby is incorporated by reference in entirety, also may be present. The additive may be present in an amount of from about 0.05 to about 5%, from about 0.75% to about 3.5%, in embodiments, of from about 0.1 to about 2% of the toner, which additives may be added during the aggregation or blended into the formed toner product.

Silica, for example, may enhance toner flow, tribo control, admix control, improved development and transfer stability and higher toner blocking temperature. Zinc, calcium or magnesium stearate also may provide developer conductivity, tribo enhancement, higher toner charge and charge stability. The external surface additives may be used with or without a coating or shell.

The gloss of a toner may be influenced by the amount of retained metal ion, such as, $Al^{3+}$, in a particle. The amount of retained metal ion may be adjusted further by the addition of a chelator, such as, EDTA. In embodiments, the amount of retained catalyst, for example, $Al^{3+}$, in toner particles of the present disclosure may be from about 0.1 pph to about 1 pph, in embodiments, from about 0.25 pph to about 0.8 pph, in embodiments, about 0.5 pph. The gloss level of a toner of the instant disclosure may have a gloss, as measured by Gardner gloss units (ggu), of from about 20 ggu to about 100 ggu, in embodiments, from about 50 ggu to about 95 ggu, in embodiments, from about 60 ggu to about 90 ggu.

Hence, a particle may contain at the surface one or more silicas, one or more metal oxides, such as, a titanium oxide and a cerium oxide, a lubricant, such as, a zinc stearate and so on. In some embodiments, a particle surface may comprise two silicas, two metal oxides, such as, titanium oxide and cerium oxide, and a lubricant, such as, a zinc stearate. All of those surface components may comprise about 5% by weight of a toner particle weight. There may also be blended with the toner compositions, external additive particles including flow aid additives, which additives may be present on the surface of the toner particles. Examples of these additives include metal oxides like titanium oxide, tin oxide, mixtures thereof, and the like; colloidal silicas, such as AEROSIL®, metal salts and metal salts of fatty acids, including zinc stearate, aluminum oxides, cerium oxides, and mixtures thereof. Each of the external additives may be present in embodiments in amounts of from about 0.01 to about 5 wt %, from about 0.05 to about 3 wt %, or from about 0.1 to about 1 wt %, of the toner. Several of the aforementioned additives are illustrated in U.S. Pat. Nos. 3,590,000, 3,800,588, and 6,214,507, the disclosures which are incorporated herein by reference.

A desirable characteristic of a toner is sufficient release of the paper image from the fuser roll. For oil containing fuser rolls, the toner may not contain a wax. However, for fusers without oil on the fuser (usually hard rolls), the toner will usually contain a lubricant like a wax to provide release and stripping properties. Thus, a toner characteristic for contact fusing applications is that the fusing latitude, that is, the temperature difference between the minimum fixing temperature (MFT) and the hot offset temperature, should be from about 50° C. to about 100° C., from about 75° C. to about 100° C., from about 80° C. to about 100° C. and from about 90° C. to about 95° C.

For the evaluation of toner particles, the parent charge was measured by conditioning the toner at a specific TC (toner concentration, e.g., 8%) with standard 35 μm polymer-coated ferrite particle, in both the A zone and the C zone overnight, followed by charge evaluation after either 2 minutes or 60 minutes of mixing on a Turbula mixer. Humidity sensitivity is an important charging property for EA toners. The charging performance was tested in two environmental chambers, one comprising low humidity conditions (also known as the C zone), while the one comprises high humidity conditions (also known as the A zone). The quantity of charge is a value measured through image analysis of the charge-spectrograph process (CSG). Toner charge-to-diameter ratios (q/d) in the C zone and the A zone, typically with a unit of either mm of displacement or in more standardized units of femtocoulombs/m, were measured on a known standard charge spectrograph. Furthermore, the tribo blow-off q/m values in μC/g also may be measured using a blow-off method with a Barbetta Box. A prescribed amount of toner is blended with the carrier. The blending is performed by, for example, a paint shaker in four (4) ounce glass jars or may be performed in a Turbula. The blending of the toner and carrier components results in an interaction, where toner particles become negatively charged and carrier particles become positively charged. Samples of the resulting mixture are loaded into a tribocage and weighed. Via instrument air, the toner is removed from the carrier, while the carrier is retained by the screened triboCage. The residual charge on the carrier is detected by an electrometer in Coulombs (relating to Tribo).

The residual charge and the weight of toner blown off may be used to calculate the Tribo. Using the weights of toner blown off and retained carrier, the toner concentration may be calculated.

Toners may possess suitable charge characteristics when exposed to extreme relative humidity (RH) conditions. The low humidity zone (C zone) may be about 10° C. and 15% RH, while the high humidity zone (A zone) may be about 28° C. and 85% RH.

Toners of the instant disclosure also may possess a parent toner charge per mass ratio (q/m) of from about −5 μC/g to about −90 μC/g, and a final toner charge after surface additive blending of from about −15 μC/g to about 80 μC/g.

Other desirable characteristics of a toner include storage stability, particle size integrity, high rate of fusing to the substrate or receiving member, sufficient release of the image from the photoreceptor, nondocument offset, use of smaller-sized particles and so on, and such characteristics may be obtained by including suitable reagents, suitable additives or both, and/or preparing the toner with particular protocols.

The dry toner particles, exclusive of external surface additives, may have the following characteristics: (1) volume average diameter (also referred to as "volume average particle diameter") of from about 2.5 to about 20 μm, in embodiments, from about 2.75 to about 10 μm, in embodiments, from about 3 to about 7.5 μm; (2) number average geometric standard deviation (GSDn) and/or volume average geometric standard deviation (GSDv) of from about 1.18 to about 1.30, in embodiments, from about 1.21 to about 1.24; and (3) circularity of from about 0.9 to about 1.0 (measured with, for example, a Sysmex FPIA 2100 analyzer), in embodiments, from about 0.95 to about 0.985, in embodiments, from about 0.96 to about 0.98.

III. Developers

A. Composition

The toner particles thus formed may be formulated into a developer composition. For example, the toner particles may be mixed with carrier particles to achieve a two component developer composition. The toner concentration in the developer may be from about 1% to about 25% by weight of the total weight of the developer, in embodiments, from about 2% to about 15% by weight of the total weight of the developer, with the remainder of the developer composition being the carrier. However, different toner and carrier percentages may be used to achieve a developer composition with desired characteristics.

1. Carrier

Examples of carrier particles for mixing with the toner particles include those particles that are capable of triboelectrically obtaining a charge of polarity opposite to that of the toner particles. Illustrative examples of suitable carrier particles include granular zircon, granular silicon, glass, steel, nickel, ferrites, iron ferrites, silicon dioxide, one or more polymers and the like. Other carriers include those disclosed in U.S. Pat. Nos. 3,847,604; 4,937,166; and 4,935,326.

In embodiments, the carrier particles may include a core with a coating thereover, which may be formed from a polymer or a mixture of polymers that are not in close proximity thereto in the triboelectric series, such as, those as taught herein or as known in the art. The coating may include fluoropolymers, such as polyvinylidene fluorides, terpolymers of styrene, methyl methacrylates, silanes, such as triethoxy silanes, tetrafluoroethylenes, other known coatings and the like. For example, coatings containing polyvinylidenefluoride, available, for example, as KYNAR 301F™, and/or PMMA, for example, having a weight average molecular weight of about 300,000 to about 350,000, such as, commercially available from Soken, may be used. In embodiments, PMMA and polyvinylidenefluoride may be mixed in proportions of from about 30 to about 70 wt % to about 70 to about 30 wt %, in embodiments, from about 40 to about 60 wt % to about 60 to about 40 wt %. The coating may have a coating weight of, for example, from about 0.1 to about 5% by weight of the carrier, in embodiments, from about 0.5 to about 2% by weight of the carrier.

In embodiments, PMMA, for example, may be copolymerized with any desired monomer, so long as the resulting copolymer retains a suitable particle size. Suitable monomers include monoalkyl or dialkyl amines, such as, a dimethylaminoethyl methacrylate, diethylaminoethyl methacrylate, diisopropylaminoethyl methacrylate or butylaminoethyl methacrylate, and the like.

Various effective suitable means may be used to apply the polymer to the surface of the carrier core, for example, cascade roll mixing, tumbling, milling, shaking, electrostatic powder cloud spraying, fluidized bed mixing, electrostatic disc processing, electrostatic curtain processing, combinations thereof and the like. The mixture of carrier core particles and polymer then may be heated to enable the polymer to melt and to fuse to the carrier core. The coated carrier particles then may be cooled and thereafter classified to a desired particle size.

The carrier particles may be prepared by mixing the carrier core with polymer in an amount from about 0.05 to about 10% by weight, in embodiments, from about 0.01 to about 3% by weight, based on the weight of the coated carrier particle, until adherence thereof to the carrier core is obtained, for example, by mechanical impaction and/or electrostatic attraction.

In embodiments, suitable carriers may include a steel core, for example, of from about 25 to about 100 μm in size, in embodiments, from about 50 to about 75 μm in size, coated with about 0.5% to about 10% by weight, in embodiments, from about 0.7% to about 5% by weight of a polymer mixture including, for example, methylacrylate and carbon black, using the process described, for example, in U.S. Pat. Nos. 5,236,629 and 5,330,874.

IV. Devices Comprising a Toner Particle

Toners and developers may be combined with a number of devices ranging from enclosures or vessels, such as, a vial, a bottle, a flexible container, such as a bag or a package, and so on, to devices that serve more than a storage function.

A. Imaging Device Components

The toner compositions and developers of interest may be incorporated into devices dedicated, for example, to delivering same for a purpose, such as, forming an image. Hence, particularized toner delivery devices are known, see, for example, U.S. Pat. No. 7,822,370, and may contain a toner preparation or developer of interest. Such devices include cartridges, tanks, reservoirs and the like, and may be replaceable, disposable or reusable. Such a device may comprise a storage portion; a dispensing or delivery portion; and so on; along with various ports or openings to enable toner or developer addition to and removal from the device; an optional portion for monitoring amount of toner or developer in the device; formed or shaped portions to enable siting and seating of the device in, for example, an imaging device; and so on.

B. Toner or Developer Delivery Device

A toner or developer of interest may be included in a device dedicated to delivery thereof, for example, for recharging or refilling toner or developer in an imaging device component, such as, a cartridge, in need of toner or developer, see, for example, U.S. Pat. No. 7,817,944, wherein the imaging device component may be replaceable or reusable.

V. Imaging Devices

The toners or developers may be used for electrostatographic or electrophotographic processes, including those disclosed in U.S. Pat. No. 4,295,990, the disclosure of which hereby is incorporated by reference in entirety. In embodiments, any known type of image development system may be used in an image developing device, including, for example, magnetic brush development, jumping single component development, hybrid scavengeless development (HSD) and the like. Those and similar development systems are within the purview of those skilled in the art.

Imaging processes include, for example, preparing an image with an electrophotographic device including, for example, one or more of a charging component, an imaging component, a photoconductive component, a developing component, a transfer component, a fusing component and so on. The electrophotographic device may include a high speed printer, a color printer and the like.

In embodiments, an imaging process includes contacting toner particles with a substrate, wherein said particles comprise OTS-treated silica and fusing said toner particles to said substrate to form an image, wherein the image for a 100% single color solid area (SCSA) layer has a thickness of between about 0.1 μm to about 10 μm, from about 1 μm to about 8 μm, from about 2 μm to about 6 μm, and wherein the thickness of said image is less than about 80%, less than about 70%, less than about 60% of the diameter of one of said toner particles. The ratio of the SCSA layer thickness after and before fusing is less than about 0.85, less than about 0.75, less than about 0.65, less than about 0.55. The 100% SCSA optical density is from about 1.4 to about 2.5, from about 1.5 to about 2.3, from about 1.8 to about 2.1. In embodiments, the TMA divided by the volume diameter of the toner particle, which can be less than about 7 μm, less than about 6 μm, less than about 5 μm, less than about 4 μm, is from about 0.03 to about 0.1, from about 0.05 to about 0.075, from about 0.055 to about 0.07 $mg/cm^2/\mu m$.

Once the image is formed with toners/developers via a suitable image development method, such as any of the aforementioned methods, the image then may be transferred to an image receiving medium or substrate, such as, a paper and the like. In embodiments, the fusing member or component, which may be of any desired or suitable configuration, such as, a drum or roller, a belt or web, a flat surface or platen, or the like, may be used to set the toner image on the substrate. Optionally, a layer of a liquid, such as, a fuser oil may be applied to the fuser member prior to fusing.

Printers may be monochrome or polychromes comprising n or more colors, wherein n is 2, 3, 4, 5, 6, 7, 8, 9 or more. Color printers commonly use four housings carrying different colors to generate full color images based on black plus the standard printing colors, cyan, magenta and yellow. However, in embodiments, additional housings may be desirable, including image generating devices possessing five housings, six housings or more, thereby providing the ability to carry additional toner colors to print an extended range of colors (extended gamut).

In embodiments, the printing process includes a semi conductive magnetic brush (SCMB) development system. Such systems are disclosed in U.S. Pat. Nos. 7,548,716 and 7,485,400; each of which is incorporated herein by reference in entirety.

The following Examples illustrate embodiments of the instant disclosure. The Examples are intended to be illustrative only and are not intended to limit the scope of the present disclosure. Parts and percentages are by weight unless otherwise indicated. As used herein, "room temperature," (RT) refers to a temperature of from about 20° C. to about 30° C.

EXAMPLES

Additive Dielectric Loss.

The additive dielectric loss (E") measurement was obtained using a standard procedure with a custom-made fixture connected to an HP4263B LCR meter via shielded 1 meter BNC cables. To insure reproducibility and consistency, one gram of toner or additive (conditioned under C zone conditions for 24 h) was placed in a 2 in diameter mold and pressed by a precision-ground plunger at about 2000 psi for 2 minutes. While maintaining contact with the plunger (which acts as one electrode), the pellet is then forced out of the mold onto a spring-loaded support, which keeps the pellet under pressure and also acts as the counter electrode. The current set-up eliminates the need for using additional contact materials (such as tin foils or grease) and also enables the in situ measurement of pellet thickness. Dielectric and dielectric loss are determined by measuring the capacitance (Cp) and the loss factor (D) at 100 KHz frequency and 1 VAC. The measurements were carried out under ambient conditions.

The dielectric constant was calculated as $E'=[Cp(pF)\times \text{thickness (mm)}/[8.854\times A_{effective}\ (m^2)]$. The constant, 8.854, is the vacuum electrical permittivity, $\in_0$, but in units that take into account that Cp is in picofarads, not farads and thickness is in mm (not meters). $A_{effective}$ is the effective area of the sample. Dielectric loss is E'* dissipation factor, which basically is how much electrical dissipation there is in the sample (how leaky the capacitor is). That is multiplied by 1000 to simplify the values. Thus, a reported dielectric loss value of 70 indicates a dielectric loss of $70\times10^{-3}$ or 0.070.

In Table 1, the dielectric loss for all of the seven surface additives of an additive package is listed (the top 7 entries), along with that of TG-C190 (an example of a surface additive of interest) in the last row. The illustrative surface additive of interest, TG-C190, was used as a replacement for X24 in the additive package for the experimental toner. The total additive loading for the X24-containing additive package was 6.04%, and with the additive package containing TG-C109, the total loading was 5.96%. $V_f$ is the volume fraction of the additive in the additive package and is calculated as weight % of the additive in the additive package divided by the density of the additive divided by the total volume of all the additives (the sum of the weight of each additive divided by the density of each additive).

TABLE 1

Additives package (top 7) and AS silica replacement.

| Additive ID | Additive Type | wt % to the parent particles | E' Dielectric constant | E" × 1000 (dielectric loss) | $V_f$ of total additive package | $V_f$ × E" × 1000 |
|---|---|---|---|---|---|---|
| RX50 | HMDS silica | 0.91% | 4.63 | 0 | 0.15 | 0 |
| RY50L | PDMS silica | 1.35% | 6.05 | 0 | 0.22 | 0 |
| MP116CF | PMMA | 0.53% | 4.61 | 31 | 0.16 | 5 |

TABLE 1-continued

Additives package (top 7) and AS silica replacement.

| Additive ID | Additive Type | wt % to the parent particles | E' Dielectric constant | E" × 1000 (dielectric loss) | $V_f$ of total additive package | $V_f$ × E" × 1000 |
|---|---|---|---|---|---|---|
| ZnFP | Zn stearate) | 0.19% | 2.19 | 0 | 0.07 | 0 |
| E10 | cerium dioxide | 0.30% | 9.11 | 2945 | 0.01 | 29 |
| STT100H | titania | 0.93% | 5.70 | 518 | 0.09 | 46 |
| X24 | HMDS sol-gel silica | 1.83% | 4.32 | 223 | 0.30 | 67 |
| TG-C190 | OTS sol-gel silica | 1.75% | 3.03 | 27 | 0.29 | 8 |

The toner additives show a wide range of loss performance. Cerium dioxide, small sized titanium and HMDS surface-treated sol-gel silica have the highest loss values. The OTS sol-gel silica has a low loss value. The $V_f$ of each additive in the total volume of the additive package multiplied by the dielectric loss (E"×1000) shows the contribution of the loss of each additive to the overall loss of the additive package on the toner particle, which depends both on the additive loss and the amount of that additive in the additive package. The X24 sol-gel silica has the highest dielectric loss volume fraction contribution in the control additive package. On the other hand, the TG-C190 OTS sol-gel silica has one of the lower levels of contribution. The average of the ($V_f$×E"×1000) for an additive of the full additive package with X24 is 23, for the full additive package with TG-C190 replacing the X24, the average contribution of each additive is 14.

Example 1

Preparation of 20 Gallon EA Toner with 1% CB in Shell

Two amorphous emulsions (7 kg polyester A ($M_w$=86,000, $T_g$ onset=56° C., 35% solids and 7 kg polyester B ($M_w$=19,400, $T_g$ onset=60° C., 35% solids), 2 kg crystalline polyester C ($M_w$23,300, $M_n$=10,500, $T_m$=71° C., 35% solids), 2% surfactant (DOWFAX® 3A1, Dow Chemical Company), 3 kg polyethylene wax emulsion ($T_m$=90° C., 30% solids, The International Group, Inc. (IGI)), 5.3 kg black pigment (Nipex-35, Evonik) and 917 g pigment (PB 15:3 Dispersion) were mixed in a reactor, then pH adjusted to 4.2 using 0.3M nitric acid. The slurry then was treated in a CAVITRON homogenizer with the use of a re-circulating loop for a total of 50 minutes, where during the first 5 minutes the coagulant, consisting of 2.96 g aluminium sulphate mixed with 36.5 g deionized (DI) water, was added inline. The reactor mixing speed was increased from 100 rpm to 310 rpm once all the coagulant was added. The slurry then was aggregated at a batch temperature of 42° C. During aggregation, a shell comprised of the same amorphous resins as in the core and 700 g of the same black pigment as in the core were mixed and was pH adjusted to 3.3 with nitric acid, and the mixture was added to the batch. The batch was heated further to achieve the targeted particle size. Once the target particle size was reached, the aggregation step was frozen with pH adjustment to 7.8 using NaOH and EDTA. The process was continued with the reactor temperature ($T_r$) being increased to 85° C., at the desired temperature the pH was adjusted to 6.8 using pH 5.7 sodium acetate/acetic acid buffer where the particles began to coalesce. After about two hours, particles achieved >0.965 circularity and the preparation was quench cooled using a heat exchanger. Final toner particle size, $GSD_V$ and $GSD_r$, were 5.48/1.20/1.22, respectively, and the fines (1.3-4 μm), coarse (>16 μm) and circularity were 15.99%, 0% and 0.976, respectively. Toners were washed with three DI water washes at room temperature and dried using an ALJET THERMAJET dryer, Model 4.

Example 2

Additive Blending

The control toner tested of the present disclosure was prepared with the toner particles of Example 1 and the additive package as detailed in Table 1 comprising 1.35% RY50L, 0.91% RX50, 0.93% STT100H, 1.83% X24, 0.30% E10, 0.19% ZnPF and 0.53% MP116CF. The weight % value is relative to the weight of parent particles. The experimental toner was the same except that the HMDS sol-gel silica, X24, was replaced by the OTS sol-gel silica of interest, TG-C190 (Cabot) (1.75%). The operating procedure was as follows: 65 g of parent particles and the appropriate amount of additives based on the formula above were blended in a Fuji blender at 13,500 rpm for 30 seconds. The blends were then put through a 45 μm sieve (USA standard Testing Sieve, A.S.T.M. E-11 from Gibson) under vibration (Model MEINZERII, Entela) to filter any large chunks.

Example 3

Effect of Additive Package on Toner

Although the amount of any one particular additive of the additive package in a toner particle and developer is low, the total dielectric loss of the toner particle comprising the additive package containing X24 was lower than that of the toner particle without an additive package, and the total dielectric loss of the toner particle comprising the additive package with TG-C190 was even lower than that of the additive package containing X24.

Hence, the overall performance of a toner particle was influenced by the use of an additive package component at the amounts used in a developer.

Example 4

Effect of Dielectric Loss on Additive Charge

The bench charging was carried out using standard procedures (see, e.g., U.S. Pat. No. 7,574,128, herein incorporated by reference in its entirety). Developer samples were prepared with 0.5 g of the toner sample and 10 g of polymer-coated 35 μm ferrite carrier. A duplicate developer sample pair was prepared. One developer of the pair was conditioned overnight under A zone conditions (28° C./85% RH) and the other was conditioned overnight under C zone conditions (10° C./15% RH). The next day the developer samples were sealed and agitated for 2 minutes and then 1 hour using a TURBULA mixer. After 2 minutes and 1 hour of mixing, the toner tribo charge was measured using a charge spectrograph in a 100 V/cm field. The toner charge (q/d) was measured visually as the midpoint of the toner charge distribution. The charge was reported in millimeters of displacement from the zero line. Following the 1 hour of mixing, an additional 0.5 g of toner sample was added to the already charged developer, and mixed for a further 15 seconds, where a q/d displacement was again measured, and then mixed for an additional 45 seconds (total mixing time of 1 minute), and again a q/d displacement was measured.

The data and comparisons revealed that the AS sol-gel silica almost enhanced q/d and q/m about two-fold at 60 minutes.

Example 5

A Zone Machine Evaluation, Including IQ Analysis

The developers were prepared at 12% toner concentration with total of 450 g of developer as described above. The toners (54 g) and carriers (396 g) were weighed and put in a 1 L clear glass jar. The bottle was placed under A zone conditions overnight without the lid to condition both the toners and carriers. The next morning, the jar was sealed and put on a TURBULA to mix for 10 minutes to yield a developer. The developer then was filled in a developer housing, which was then installed in a Digital Color Press machine (DCP700) right away. The printer was set under machine control with all the non-volatile memories (NVMs) initialized. However, the dispenser was not used by setting the appropriate NVMs to 0. Image quality prints (a pattern of half tones, solid areas, lines etc. for assessing graininess and a large patch of half tones and solid areas for assessing mottle) were printed on an uncoated paper under color mode for IQ analysis. Toner mass per unit area (TMA) was obtained on both the belt and the paper to determine $2^{nd}$ transfer efficiency. TC and tribo were also measured. After completing the initial TC (12%) point, 7.5% area coverage prints were analyzed to run TC down to 10%, 8% and 6%. At each TC, IQ prints, TMA and TC and tribo were determined.

The OTS silica provided improved tribo charge at all test points, about 20% greater at each TC % tested between 5 and 10% as shown in Table 2. Also, the OTS silica provided an average transfer efficiency (TE) around 78%, much better than control HDMS sol-gel silica with a TE of around 60%, with a strong dependence on tribo. Finally, graininess and mottle were substantially better for toner with the OTS sol-gel silica.

TABLE 2

Toner concentration (TC) and Tribo of the Control Toner (X24) and Experimental Toner (TGC-190)

| Sample ID | 6.5% TC | 9% TC |
|---|---|---|
| Control | 33.4 | 25.4 |
| Experimental | 56.6 | 38.9 |

Hence, the A zone machine test demonstrated that using an AS silica boosted the tribo, and improved the $2^{nd}$ transfer efficiency and IQ (graininess and mottle).

It will be appreciated that several of the above-disclosed and other features and functions, or alternatives thereof, may be desirably combined into many other different systems or applications. Also various presently unforeseen or unanticipated alternatives, modifications, variations or improvements therein may be subsequently made by those skilled in the art, which are also intended to be encompassed by the following claims. Unless specifically recited in a claim, steps or components of claims should not be implied or imported from the specification or any other claims as to any particular order, number, position, size, shape, angle, color or material.

All references cited herein are herein incorporated by reference in their entireties.

We claim:

1. A toner composition comprising toner particles and, an additive package comprising one or more low dielectric loss additives, wherein the average of the volume fraction contribution of each additive to total dielectric loss of said package, calculated as $V_f \times E'' \times 1000$, wherein $V_f$ is volume fraction by weight of each additive and E" is dielectric loss, is from about 0 to about 60 and wherein at least one of the low dielectric loss additive comprises a sol-gel silica surface treated with octyl triethoxy silane that is a replacement for sol-gel silica surface treated with hexamethyl disilazane (HMDS).

2. The toner composition of claim 1, wherein the volume traction dielectric loss contribution of each additive in the additive package is less than about 40.

3. The toner composition of claim 1, wherein the volume fraction dielectric loss contribution of each additive in the additive package is less than about 30.

4. The toner composition of claim 1, wherein the average dielectric, loss contribution of said one or more additives is less than about 20.

5. The toner composition of claim 1, wherein the dielectric loss of the additive package is less than about 100.

6. The toner composition of claim 1, wherein the dielectric loss of the toner particles including the additives is less than about 150.

7. The toner composition of claim 1, further comprising a first amorphous resin, an optional second amorphous resin, an optional crystalline resin, an optional surfactant, an optional wax, an optional shell, and optionally one or more colorants.

8. The toner composition of claim 1, wherein the primary particles size of said one or more additives is between about 5 nm and 600 nm.

9. The toner composition of claim 1, wherein said toner particles are hyperpigmented.

10. The toner composition of claim 1, wherein said sol-gel silica comprises a volume fraction loss contribution to the additive package of less than about 20.

11. The toner of composition of claim 1. wherein the toner particles comprise a black pigment.

12. An imaging process comprising:

contacting toner composition of claim 1 with a substrate; and fusing said toner composition to said substrate to form an image, wherein the image for a 100% single color solid area (SCSA) layer has a thickness of between about 0.1 μm to about 10 μm, and wherein the thickness of said image is less than about 70% of the diameter of one of said toner particles.

13. The imaging process of claim 12, wherein the toner particles of said composition comprise a first amorphous resin, an optional second amorphous resin, an optional crystalline emulsion, an optional surfactant, an optional wax, optionally a shell, and optionally one or more colorants.

14. The imaging process of claim 12, wherein the ratio of toner mass per unit area (TMA) on the substrate to the volume diameter of the toner particles is from about 0.05 $mg/cm^2/\mu m$ to about 0.075 $mg/cm^2/\mu m$.

15. The imaging process of claim 14, wherein the toner volume diameter is less than about 5 μm.

16. The imaging process of claim 12, comprising a black pigment.

17. The imaging process of claim 12, further comprising printing said image by applying said contacting and fusing to all toner color layers.

18. A toner composition comprising hyperpigmented toner particles comprising a black colorant and, an additive package comprising one or more low dielectric loss additives, wherein the average of the volume fraction contribution of each additive to total dielectric loss of said package, calculated as $V_f \times E'' \times 1000$, wherein $V_f$ is volume fraction by weight of each additive and E" is dielectric loss, is from about 0 to about 60 and wherein at least one low dielectric loss additive comprises a sol-gel silica surface treated with octyl triethoxy silane that is a replacement for sol-gel silica surface treated with hexamethyl disilazane (HMDS).

* * * * *